US006202630B1

(12) United States Patent
Yip

(10) Patent No.: US 6,202,630 B1
(45) Date of Patent: Mar. 20, 2001

(54) OPEN THROTTLE TORQUE CONTROL

(75) Inventor: James W. Yip, Pinckney, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/351,832

(22) Filed: Jul. 13, 1999

(51) Int. Cl.[7] ..... F02D 41/16
(52) U.S. Cl. ..... 123/352
(58) Field of Search ..... 123/350, 352, 123/399, 361, 406.23; 477/109, 181

(56) References Cited

U.S. PATENT DOCUMENTS

| | | | |
|---|---|---|---|
| 4,030,460 | 6/1977 | Tanaka et al. | 123/406.7 |
| 4,905,544 | 3/1990 | Ganoung | 427/109 |
| 4,964,318 | 10/1990 | Ganoung | 477/110 |
| 4,968,999 | 11/1990 | Fodale et al. | 701/54 |
| 4,969,098 | 11/1990 | Leising et al. | 701/59 |
| 5,186,080 * | 2/1993 | Simon, Jr. et al. | 477/109 |
| 5,253,623 * | 10/1993 | Melnyk et al. | 123/339.1 |
| 5,374,224 * | 12/1994 | Huffmaster et al. | 477/181 |
| 5,437,253 * | 8/1995 | Huffmaster et al. | 123/399 |
| 5,445,576 | 8/1995 | Motamedi | 477/105 |
| 5,463,993 * | 11/1995 | Livshiz et al. | 123/352 |
| 5,479,898 | 1/1996 | Cullen et al. | 123/350 |
| 5,559,703 | 9/1996 | Iwata et al. | 701/86 |
| 5,577,474 * | 11/1996 | Livshiz et al. | 123/352 |
| 5,623,906 | 4/1997 | Storhok | 123/406.23 |
| 5,713,332 * | 2/1998 | Adler et al. | 701/104 |
| 5,833,572 | 11/1998 | Leising et al. | 477/113 |

* cited by examiner

*Primary Examiner*—Tony M. Argenbright
*Assistant Examiner*—Hieu T. Vo
(74) *Attorney, Agent, or Firm*—Mark P. Calcaterra

(57) ABSTRACT

A method is provided for controlling engine torque during a closed to open throttle transition in order to eliminate undesirable accelerations and oscillations from the powertrain.

4 Claims, 3 Drawing Sheets

OPEN THROTTLE TORQUE CONTROL

BACKGROUND OF THE INVENTION

1. Field of the Invention

The present invention relates generally to engine controls, and more particularly to an engine torque control algorithm to reduce undesirable accelerations and oscillations from the powertrain during a closed throttle to open throttle transition.

2. Background and Summary of the Invention

Vehicles equipped with manual transmissions will develop a rapid undesirable acceleration (known as jerk) and oscillations (known as bobble) from the powertrain during the closed throttle to open throttle transition. Typically, what happens when the accelerator pedal is released during low speed operation such as city driving, and is then subsequently reapplied, the engine produces a sudden increase in torque which causes some of the powertrain components such as the drive shaft to twist (somewhat like a torsion spring), as the components of a powertrain become spring loaded, the release of the spring tension creates the undesirable accelerations and oscillations which are most prominently experienced during low speed operation of a vehicle having a manual transmission.

The present invention provides a torque algorithm to control the rate at which torque is produced from the engine. On manual transmission vehicles equipped with mechanical throttle bodies, spark advance/retard has the greatest effect on controlling the torque rate. The control system of the present invention controls spark advance/retard in order to control the torque rate.

The present invention provides a torque control algorithm for reducing jerk and bobble for an automotive vehicle powertrain including means for determining a proportional error term by monitoring an amount of torque the engine will produce and is presently producing during a closed to open throttle transition. Means are provided for determining a derivative error term by monitoring a rate of change of the engine speed during a closed to open throttle transition. Means are provided for determining a torque error term as the greater of the proportional error term and the derivative error term. Means are further provided for converting the torque error term to a spark compensation amount and for delivering the spark compensation amount to an engine control scheme. The proportional error term is determined based upon a sum of a potential torque term and a desired torque term minus an actual torque term. The derivative error term is determined based upon a derivative of engine acceleration over time since open throttle. The derivative error term is compared to be within a control window, and if not, is converted to a torque error value.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
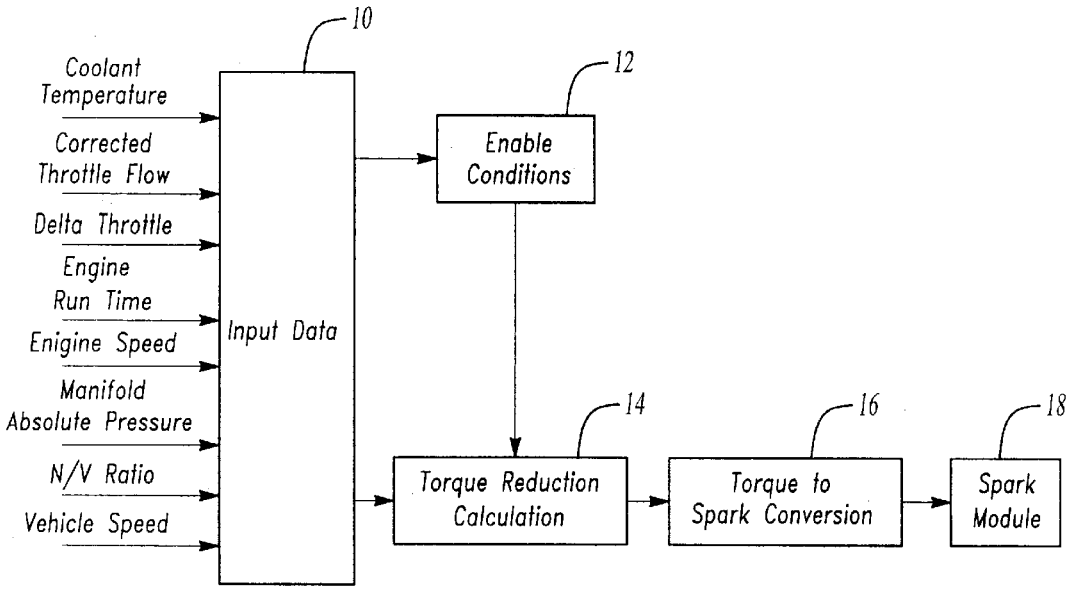
FIG. 1 is a block diagram of the open throttle torque control scheme of the present invention.

As described hereinbelow, the engine torque control algorithm of the present invention controls engine spark advance/retard in order to reduce and/or eliminate jerk and bobble. With reference to FIG. 1, a block diagram of the control scheme of the present invention is shown. The control scheme includes an input block 10 which receives data including coolant temperature, corrected throttle flow, delta throttle, engine run time, engine speed, manifold absolute pressure, engine/vehicle speed ratio, and vehicle speed. Each of these values is typically available from the engine controller which keeps track of, and updates each of, the above data. The control scheme as shown in FIG. 1 includes an enable conditions block 12 which is described in greater detail with reference to FIG. 2. If the control scheme is enabled as determined in the block diagram shown in FIG. 2, the control scheme includes a torque reduction calculation block 14 which determines the proportional and derivative control term which will be described in greater detail herein. The torque reduction calculation block 14 provides a torque error term to block 16 which provides a torque to spark conversion which is then delivered to the engine controller as illustrated in block 18.

Figure 2:
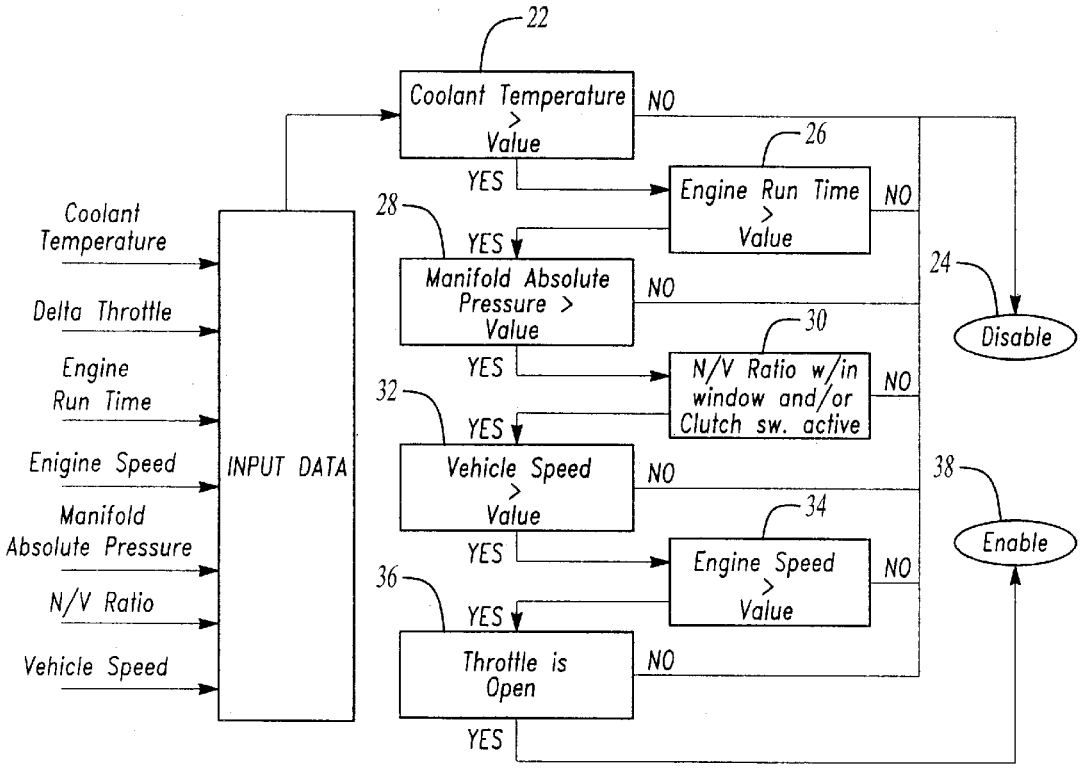
FIG. 2 is a block diagram of the enabling conditions for the open throttle torque control scheme according to the principles of the present invention.

With reference to FIG. 2, the enable conditions block 12 will be described in greater detail. Briefly, the enabling conditions require that the coolant temperature, engine run time, manifold absolute pressure, vehicle speed and engine speed all exceed predetermined values, that the throttle is open and that the engine speed/vehicle speed ratio is within a predetermined window and/or the clutch switch is active. Specifically, the enable conditions block first determines at block 22 if the coolant temperature is greater than a predetermined value. If not, the open throttle torque control scheme of the present invention is disabled at block 24. If the coolant temperature is greater than a predetermined value, then the enable conditions block 12 determines if the engine run time is greater than a predetermined value at block 26. If not, the control scheme of the present invention is disabled at block 24. If the engine run time is determined to be greater than a predetermined value at block 26, then control proceeds to block 28 wherein it is determined whether the manifold absolute pressure is greater than a predetermined value. If not, the control scheme of the present invention is disabled at block 24. If at block 28, the manifold absolute pressure is determined to be greater than a predetermined value, then the control scheme proceeds to block 30 where it is determined where the engine and vehicle speed ratio is within a predetermined window and/or the clutch switch is active. If not, the control scheme is disabled at block 24. If the engine/vehicle speed ratio is within the predetermined window and/or the clutch switch is active, the control proceeds to block 32 where is determined whether the vehicle speed is greater than a predetermined value. If not, the control scheme is disabled at block 24. If the vehicle speed is determined to be greater than a predetermined value at block 32, then the control scheme proceeds to block 34 where it is determined if the engine speed is greater than a predetermined value. If not, the control scheme is disabled at block 24. If the engine speed is determined to be greater than a predetermined value at block 34, the control scheme proceeds to block 36 where it is determined if the throttle is open. If not, the control scheme is disabled at block 24. If it is determined at block 36 that the throttle is open, then the control scheme of the present invention is enabled at block 38.

The open throttle torque control system of the present invention is a proportional/derivative type control algorithm. The proportional torque error term is generated by monitoring how much torque the engine will produce and is presently producing during the closed to open throttle transition. The proportional error term for the proportional control is determined by the equation $$\text{P-term torque error}=T_{POT}+(T_D-T_A) \quad (1)$$

where $T_{POT}=T_A-T_P$ and $T_D=T_C+T_I$. $T_{pot}$ is the torque potential. $T_A$ is the actual torque which is gathered from a surface look-up table of engine speed and manifold absolute pressure on the engine control module loop time, i.e., each time the software does a complete loop.

$T_P$ is the predicted torque which is gathered from a surface look up of corrected throttle flow and engine speed. Corrected throttle flow is a flow through the throttle body corrected to barometric pressure and ambient air temperature. $T_C$ is the captured actual torque which is the actual torque at the moment the throttle is sensed open. The captured actual torque value $T_C$ is maintained until the throttle is closed again. $T_I$ is the torque increment rate which is determined from a look-up table of the torque increment rate based on engine and vehicle speed. $T_D$ is the desired torque which is equal to the captured actual torque $T_C$ plus the torque increment rate $T_I$.

Figure 4:
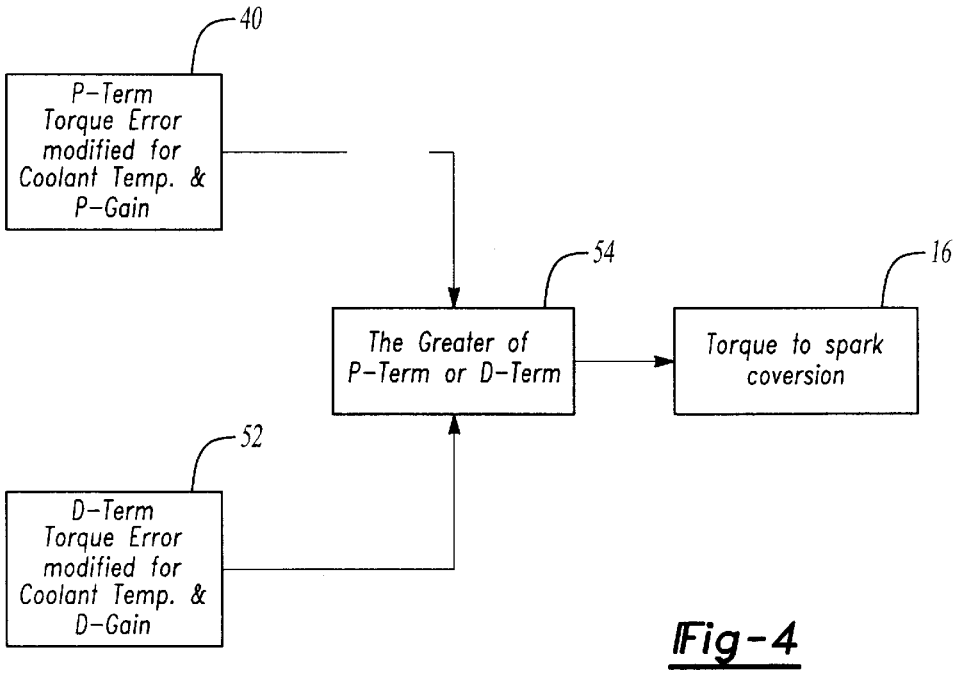
FIG. 4 is a block diagram of the torque reduction calculations for the open throttle torque control scheme of the present invention.
Figure 5:
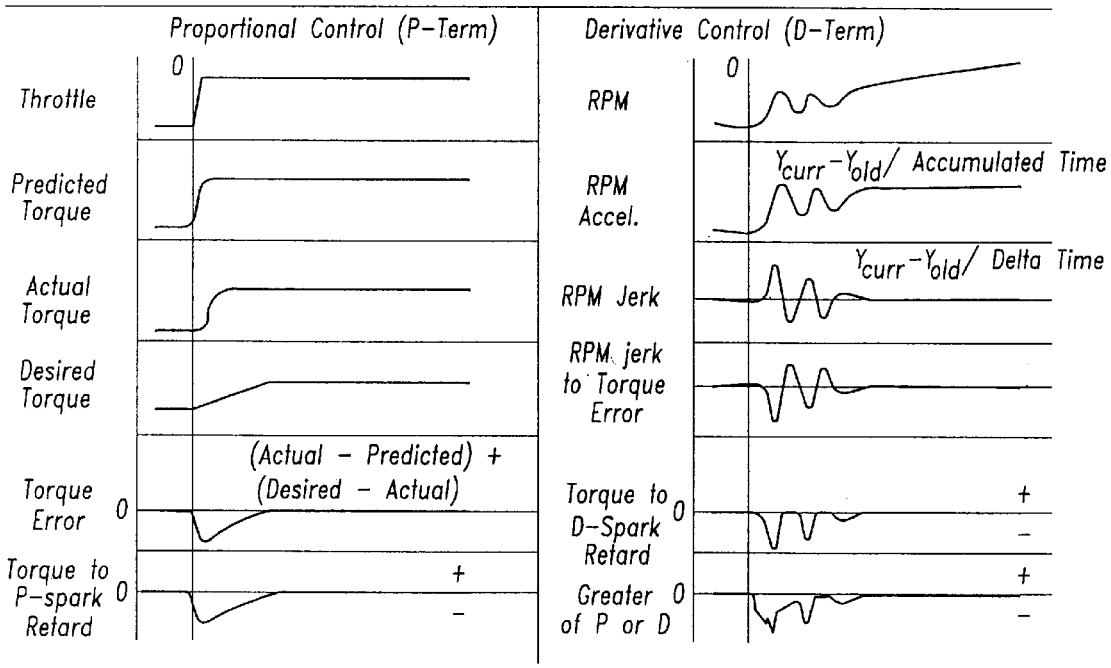
FIG. 5 provides a sample graphical illustration of each of the terms utilized in generating the proportional control term as well as the derivative control term according to the principles of the present invention.

The P-term torque error is determined according to the above equation and is provided at block 40 as shown in FIG. 4.

Figure 3:
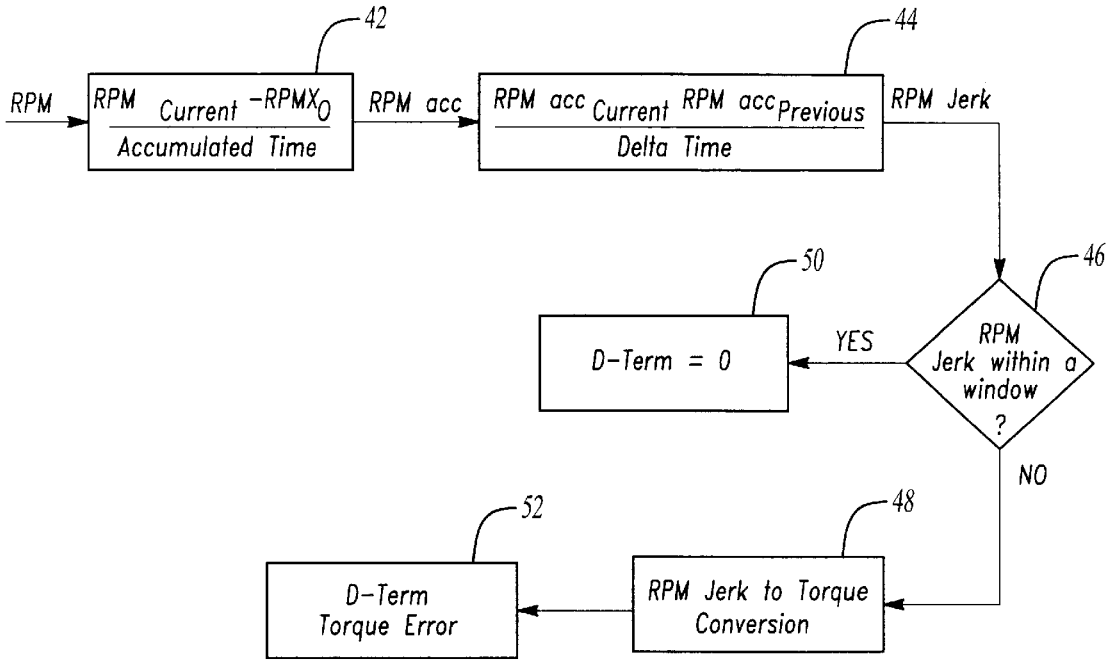
FIG. 3 is a block diagram for determining the derivative control term of the open throttle torque control scheme according to the principles of the present invention.

The error term for the derivative control (D-term torque error) is generated by the rate of change of the engine speed during a period from the closed to open throttle transition as illustrated in FIG. 3. At block 42, the engine rpm acceleration is determined based upon the equation: RPM at current time minus RPM as determined at time 0 divided by accumulated time.

The accumulated time is the time since the open throttle was detected. The RPM acceleration term is delivered to block 44 where the true derivative of the RPM acceleration is taken by subtracting the previous RPM acceleration from the current RPM acceleration value and dividing by the engine control unit loop time since the last cycle. Block 44 provides an RPM jerk term which is provided to block 46 where the RPM jerk term is compared to be within a control window. If the RPM jerk term value exceeds a predetermined high threshold value or a predetermined low threshold value, the control proceeds to block 48 where the RPM jerk term is converted to a torque error value by a table look up of RPM jerk versus D-term torque error. The D-term torque error value is supplied at block 52 in FIG. 4. An exemplary surface look-up table is provided below.

Table Look-up for RPM Acceleration to Torque Error
X-input: RPM Acceleration (RPM/sec)
Y-output: Torque Error (N-m)

| RPM Acceleration | Torque Error |
|---|---|
| 0 | 0 |
| 1000 | −25 |
| 2000 | −30 |
| 5000 | −55 |
| 10000 | −70 |
| 25000 | −90 |

If in block 46, the RPM jerk term is determined to be within the predetermined window, then the derivative term is set at 0 at block 50.

As shown in FIG. 4, the torque error is determined at block 54 to be the greater of the P-term torque error and the D-term torque error. The torque error, as determined at block 54, is converted at block 16 to an amount of spark compensation by multiplying the output of a surface look up of RPM versus manifold absolute pressure (MAP). The output of the surface look up is a number of degrees of spark per one unit of torque. An exemplary surface look-up table is provided below.

Surface Look-up for Torque to Spark conversion
X-input: RPM
Y-output: MAP (Kpa)
Surface output: No. of degrees of Spark/N-m

| MAP | | | | | | |
|---|---|---|---|---|---|---|
| 13 | .00 | .75 | .73 | .70 | .85 | .88 |
| 33 | .00 | .65 | .64 | .60 | .76 | .81 |
| 46 | .00 | .53 | .52 | .50 | .65 | .71 |
| 59 | .00 | .44 | .43 | .40 | .55 | .60 |
| 78 | .00 | .30 | .33 | .32 | .40 | .43 |
| 92 | .00 | .20 | .22 | .27 | .30 | .33 |
| RPM | | | | | | |
| | 900 | 1000 | 2000 | 3000 | 4000 | 5000 |

The spark compensation value is delivered to the engine at block 18 as shown in FIG. 1 in order to retard or advance the engine spark in order to reduce and/or eliminate the jerk and bobble associated with the close throttle to open throttle transition.

Figure 6:
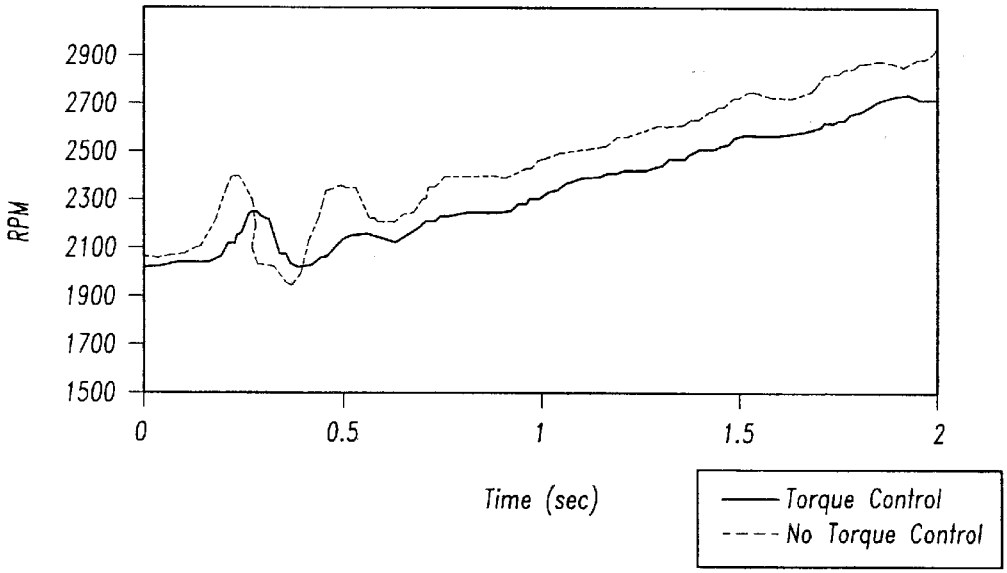
FIG. 6 is a graphical illustration of the reduced jerk and bobble that is obtained using the torque control scheme as compared to no torque control scheme according to the principles of the present invention.

With reference to FIG. 6, the engine rpm is mapped against time for the torque control system of the present invention as shown in solid lines while the dashed line represents the engine rpm with no torque control. From FIG. 6, it is clear that the magnitude of the sudden increase in torque is shown to be greatly reduced and the oscillating effect is also greatly reduced as compared to the no torque control curve.

According to the principles of the present invention, the torque reduction calculation block 14 of the present invention includes a proportional error term determination module 40 and a derivative error term determination module 52. The greater of the P-term and D-term is utilized by the torque to spark conversion module 16 in order to retard or advance the engine spark in order to reduce jerk and bobble.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of controlling torque during a closed throttle to open throttle transition for an internal combustion engine, comprising the steps:

determining a proportional error term by monitoring an amount of torque the engine will produce and is presently producing during a closed to open throttle transition;

determining a derivative error term by monitoring a rate of change of the engine speed during a closed to open throttle transition;

determining a torque error term as the greater of said proportional error term and said derivative error term;

converting said torque error term to a spark compensation amount; and delivering said spark compensation amount to an engine control scheme.

2. The method according to claim 1, wherein said proportional error term is determined based upon a sum of a potential torque term and a desired torque term minus an actual torque term.

3. The method according to claim 1, wherein said derivative error term is determined based upon a derivative of engine acceleration over time.

4. The method according to claim 3, wherein the derivative error term is compared to be within a control window, and when the derivative error term is outside said control window said derivative error term is converted to a torque error.

* * * * *